United States Patent [19]

Scheurer

[11] Patent Number: 4,510,665

[45] Date of Patent: Apr. 16, 1985

[54] CONTAINER INSULATION APPARATUS

[75] Inventor: Stephen M. Scheurer, Wichita Falls, Tex.

[73] Assignee: Texas Recreation Corporation, Wichita Falls, Tex.

[21] Appl. No.: 486,044

[22] Filed: Apr. 18, 1983

Related U.S. Application Data

[63] Continuation of Ser. No. 217,922, Dec. 18, 1980, abandoned, and Ser. No. 69,146, Aug. 23, 1979, abandoned.

[51] Int. Cl.[3] ..... B23P 3/00; B23P 19/04

[52] U.S. Cl. ..... 29/460; 29/446; 156/218; 215/100.5

[58] Field of Search ..... 220/411, 422, 85 H, 220/902, 31.1; 215/13 C, 100.5, 11 C; 229/1.5 H, 460, 447, 446; 156/218; 264/230

[56] References Cited

U.S. PATENT DOCUMENTS

| | | | |
|---|---|---|---|
| 1,632,347 | 6/1927 | Pipkin | 215/100.5 |
| 1,855,041 | 4/1932 | Bodony | 156/218 |
| 2,115,654 | 4/1938 | Swofford | 215/100.5 X |
| 2,685,319 | 8/1954 | Swasko | 215/11 C X |
| 2,952,039 | 9/1960 | Jaffe | 156/218 |
| 3,126,441 | 3/1964 | Nichols | 215/100.5 X |
| 3,155,260 | 11/1964 | Widener | 215/13 R |
| 3,285,456 | 11/1966 | Pewitt | 215/100.5 |
| 3,848,766 | 11/1974 | Gantt . | |
| 3,905,511 | 9/1975 | Groendal | 220/902 |
| 3,910,328 | 10/1975 | Marcoux . | |
| 3,941,237 | 3/1976 | MacGregor, Jr. . | |
| 4,069,996 | 1/1978 | Koziol | 220/85 H |
| 4,181,765 | 1/1980 | Harmony | 215/13 R |
| 4,268,335 | 5/1981 | Herbst | 156/218 |
| 4,271,218 | 6/1981 | Heckel et al. | 156/218 X |

*Primary Examiner*—Charlie T. Moon
*Attorney, Agent, or Firm*—James C. Wray

[57] ABSTRACT

A beverage insulation container having a wider diameter base than sidewall sleeve created by wrapping unicellular foam around a round disk and applying a vinyl coating to the sidewall to taper the sidewall sleeve above the round disk serving as the base. A hole is cut through the sidewall sleeve near the base end of the container for preventing a vacuum from forming, thereby allowing a beverage container to be withdrawn from the holder by twisting the container and simultaneously pulling the container out of the sidewall sleeve.

16 Claims, 4 Drawing Figures

CONTAINER INSULATION APPARATUS

This application is a continuation, of application Ser. No. 217,922, filed Dec. 18, 1980 now abandoned and of application Ser. No. 069,146, filed Aug. 23, 1979 now abandoned.

BACKGROUND OF THE INVENTION

1. Field of the Invention

The present invention related generally to insulation devices and more specifically to beverage insulation containers.

2. Description of the Prior Art

Pertinent art is found in Class 220, Metallic Receptacles, subclasses 68, 70, 85H, 411 and 412; Class 215, Bottles and Jars, subclasses 1C, 12R and 13R; Class 229, Paper Receptacle, subclass 105B and Class 206, Special Receptacles or Packages, subclasses 139 and 545.

Examples of the most pertinent patents include U.S. Pat. Nos.:

2,115,654
3,285,456
3,848,766
3,905,511
3,910,328
3,941,237 and
4,069,996

U.S. Pat. No. 4,069,996 shows an inwardly tapering holder for ice cream cones having an opening in the sidewall of the holder. Unlike the present invention, this hole only allows a person's finger to reach beneath the bottom of an ice cream cone to push it upward to be removed from the holder.

U.S. Pat. No. 3,285,456 shows an insulated beverage container of expandable polystyrene having a magnetic base and flexible gripping fingers which hold the beverage securely within the container to catch condensation and keep the beverage cold or hot, as desired.

U.S. Pat. No. 2,115,654 shows a bottle and can container of rubber or other elastic material having longitudinal corrugations which enable the container to grip the beverage snugly.

U.S. Pat. No. 3,848,766 shows an insulated container pack having a plurality of styrofoam cups which are part of a styrofoam package.

U.S. Pat. No. 3,905,511 shows a container for cans having a hinged cover which can enclose the beverage completely when closed and which, when open, permits access to the beverage directly without complete removal of the beverage from the container. The bottom of the holder 60 is made of resilient padding which can be secured to the container or which can be removed to permit cleaning of the jacket.

U.S. Pat. No. 3,941,237 shows a plastic container having a magnet at the base for attaching the container to a magnetic conveyor to convey cans at various angles along a conveyor path.

U.S. Pat. No. 3,910,328 shows an insulating container having a plurality of foam side elements pivotally connected to a polygonal bottom element so that the side elements fit whatever size of the container desired to be held.

None of the prior art shows a unicellular form beverage insulation container having a wider base portion and a tapering sidewall structure. Nothing in the prior art shows a hole cut through the sidewall, as in the present invention to prevent a vacuum from forming between the bottom of the beverage and the container. This permits easy withdrawal of the beverage from the insulation container. None of the prior art shows a vinyl-coated container which increases durability and attractiveness. None of the prior art shows a wider base portion than sleeve thereby lowering the center of gravity to prevent inadvertent tipping.

The present invention has a vacuum prevention aperture and a bell shaped closed end which results in maximum ease of use unlike the prior art examples. The present invention is also coated to provide it with greater durability and a finished look, which the prior art examples lack.

SUMMARY OF THE INVENTION

The present invention is a new beverage insulation container for keeping a beverage hot or cold, as desired. The present invention is a unicellular foamed container constructed by wrapping a rectangular piece of foam around a thick round disk to form a cylinder having one closed end and one open end. The closed end has a larger diameter than the open end, forming a bell shape at the closed end of the container and tapering to a narrower open end of the container. The bell shape at the closed end creates space within the container which exceeds the diameter of a beverage container.

The present invention has a pressure relief aperture which conducts air to and from the inside of the container. This aperture prevents a vacuum from forming when a beverage container is inserted into the insulation container by conducting air into the space created between the outer walls of a beverage container and the inner sidewall of the bell-shaped container. The presence of a vacuum between the walls of the beverage container and the inner sidewall of the insulation container would make removal of the beverage container extremely difficult. The presence of the aperture permits simple removal of the beverage container by a slight twist of the beverage container in conjunction with an upward pulling of the beverage container out of the insulation container.

Additionally the sidewall aperture enables the container to have a solid bottom thereby preventing condensation from forming and leakage from occurring through the bottom of the container, unlike prior art containers.

The sidewalls of the present invention inhibit changes in temperature of the beverage to a greater extent than prior art containers because the foam material clings to the shape of the beverage container, thereby preventing air from leaking in between the walls of the insulation container and the walls of the beverage container except when the beverage container is removed from the insulation container.

The present invention is coated with vinyl or other plastic material to waterproof the insulation container. Vinyl coating has no equal for lending appearance, feel, durability, cleanliness and chemical and ultra-violet resistance which prior art containers lack.

Additionally coating the container with vinyl or other plastic material compresses the container so that the container tapers above the base forming an opposite open end of slightly smaller diameter than the closed end.

The larger width of the base of the present invention than the opposite open end lowers the center of gravity to prevent inadvertent tipping of the beverage while inside the container.

The present invention is extremely durable, thereby permitting the container to be used an innumerable number of times. Prior art containers of styrofoam are easily broken and torn due to the brittle quality of styrofoam. The unicellular foam material of the present invention is flexible and resilient thereby prolonging its useful life as well as permitting more versatile use with beverage containers of odd shapes.

OBJECTS OF THE INVENTION

Objects of the invention are to provide a base, a sidewall having an inner wall, attached to the base forming a large closed end opposite a smaller open end pressure relief means extending through the sidewall whereby the pressure relief means communicates atmospheric pressure to an annular space between the inner sidewall and an outer wall of a beverage container positioned within the sidewall preventing an air-tight seal from forming between the inner sidewall and the outer wall of the beverage container thereby minimizing the difficulty of inserting or withdrawing the beverage container positioned within the inner sidewall.

Another object of the invention is to provide a base comprising a round disk.

Another object of the invention is to provide a larger closed end comprising a bell-shaped closed end.

Another object of the invention is to provide a sidewall which tapers above the larger closed end forming an opposite smaller open end.

Another object of the invention is to provide a sidewall which comprises resilient foam material.

Further objects of the invention are to provide a method of manufacturing a container insulation apparatus comprising the steps of attaching a foam sidewall to a base, forming a closed end opposite an open end, tapering the foam sidewall above the closed end, positioning a beverage holder having an outer wall within the foam sidewall, forming an annular space between the foam sidewall and the outer wall of the beverage container, communicating atmospheric pressure to the annular space between the foam sidewall and the outer wall of the beverage container.

Another object of the invention is to provide a method of manufacturing a container insulation apparatus wherein the attaching comprises wrapping the foam sidewall along a longitudinal edge around the base, forming a relatively large closed end opposite a smaller open end and connecting ends of the sidewall forming a seam perpendicular to the base.

Another object of the invention is to provide a method of manufacturing an insulation container apparatus wherein the tapering comprises coating the sidewall and the base with material to form the closed end having a larger diameter than an opposite open end.

Another object of the invention is to provide a method of manufacturing an insulation container apparatus wherein the positioning comprises inserting the beverage container into the foam sidewall forming the annular space between the foam sidewall and the outer wall of the beverage container.

Another object of the invention is to provide a method of manufacturing an insulation container apparatus wherein the communicating comprises expelling atmospheric pressure from the annular space between the foam sidewall and the outer wall of the beverage container as the beverage container is inserted into the foam sidewall and inhaling atmospheric pressure into the annular space between the foam sidewall and outer wall of the beverage container as the beverage container is withdrawn from the foam sidewall.

Figure 1:
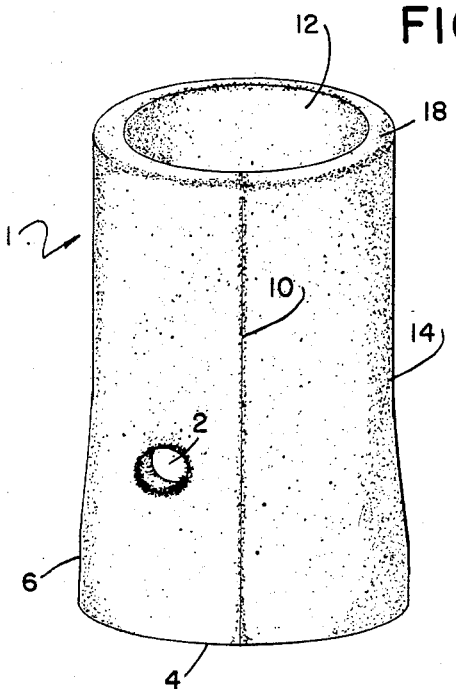
FIG. 1 shows a front elevation view.
Figure 4:
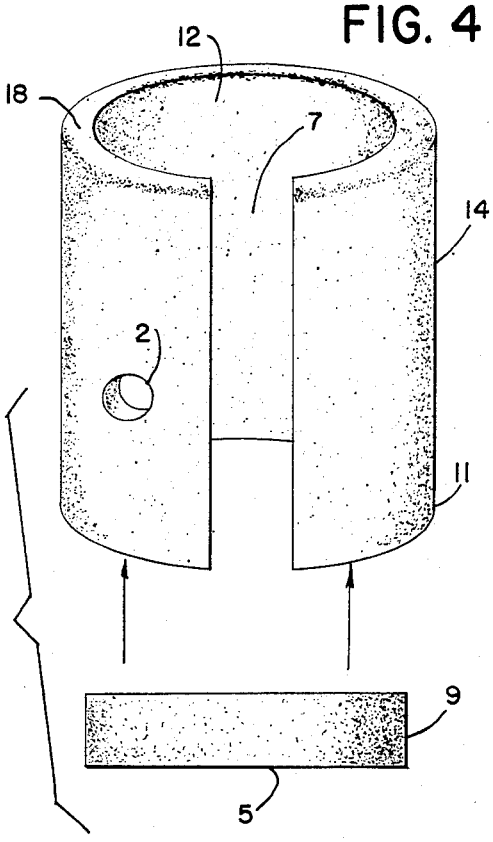
FIG. 4 shows a schematic view.

FIG. 1 shows a front elevation view of the present invention. Container insulation apparatus generally denoted by 1 has pressure relief means 2 extending through sidewall 14 permitting a free flow of air into the cylinder space 12. Insulation container 1 has a larger base end 6 opposite its open end. This is due to the round disk 5 around which sidewall 14 is wrapped, closed along seam 10. Wider base end 6 creates an annular air space (not shown) between the inner sidewall of cylinder space 12 and the outer wall of beverage container 32 as shown in FIG. 4. This annular air space in conjunction with pressure relief means 2 prevents the creation of a vacuum between inner sidewall and the outer wall of beverage holder 32. Sidewall 14 has thickness 18 of relatively thinner thickness than round disk 5. Thick round disk 5 has bottom flush with sidewall bottom 4. Thick round disk 5 provides greater insulation for the bottom of a beverage container 32 to prevent temperature changes due to heat transfer between the bottom of the beverage container and the surface upon which the container is set.

FIG. 4 shows the round disk 5 before attachment to the sidewall 14 of the container insulation device. Prior to attachment sidewall 14 has a uniform diameter from top to bottom 11. Seam 10 is formed by sealing gap 7 which exists between ends of sidewall 14. Ends of the sidewall 14 are squared to facilitate a leakproof seal. Any other shape of the ends would not prevent leakage of fluid out of the sidewall 14. The inner sidewall 14 is wrapped around the outer edge of round disk 5 thereby forming the bell shape closed end 6 as shown in FIG. 1.

Figure 3:
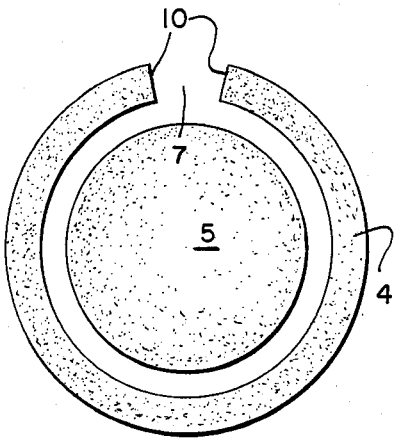
FIG. 3 shows a bottom view.

FIG. 3 is a bottom view of the container 1. Bottom 4 of sidewall 14 is wrapped flush around round disk 5. Seam 10 is formed by closing gap 7 between the square ends of sidewall 14.

Figure 2:
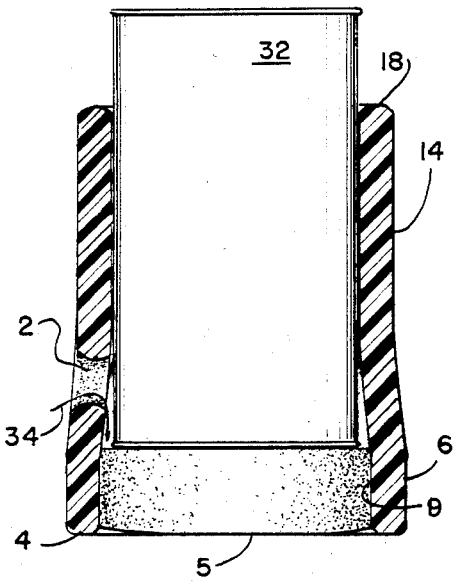
FIG. 2 shows a front cross-sectional view.

FIG. 2 is a cross-section of the container 1. Beverage container 32 is positioned inside container 1 inside sidewall 14. The outer wall of the beverage container 32 is snugly held by the sidewall 14 until the sidewall 14 flares outward due to the diameter of the round disk 5. The area between the inner sidewall 14 and the outer wall of the beverage container is an annular space in which airflow 34 circulates through pressure relief means 2. Circulation of air 34 in the annular space prevents a vacuum from forming. The vacuum would otherwise make withdrawal of a beverage container extremely difficult as the air-tight seal would create an even greater gripping of the container by the sidewall due to the unbalanced atmospheric pressure between the inner sidewall and the outer sidewall of the container insulation device 1.

I claim:

1. A method of manufacturing a container insulation apparatus comprising wrapping a generally cylindrical sheet element around a cylindrical base in one end of the element, securing an outer cylindrical surface of the base to a corresponding inner surface of the cylindrical element, securing edges of said sheet element to form a longitudinal seam forming a recessed annular space adjacent the base, coating exposed surfaces of the base and the cylindrical element and forming an opening through the container insulation apparatus in a portion thereof near the base.

2. The method of manufacturing a container insulation apparatus of claim 1 comprising forming the generally cylindrical element by initially forming a generally rectangular blank having an elongated dimension and a shorter transverse dimension and having one elongated edge portion parallel to the elongated dimension and wherein the wrapping of the cylindrical element comprises wrapping the rectangular blank around the cylindrical base with a longitudinal edge portion of one face of the blank contacting a cylindrical outer wall of the cylindrical base and securing relatively short transverse edges of the blank together prior to coating exposed surfaces of the base and cylindrical element.

3. The method of manufacturing a container insulation apparatus of claim 2 further comprising forming an opening through thr blank prior to wrapping the blank and forming the blank with a longitudinal dimension approximately twice a transverse dimension of the blank.

4. A method of manufacturing a container insulation apparatus comprising the steps of wrapping a sheet of foam on a cylindrical base to form a closed end insulated container having a sidewall tapering inwardly from the closed end part way toward an open end, connecting edges of the sidewall to form a seam perpendicular to the cylindrical base, inserting a cylindrical beverage holder into the insulated container leaving an annular space between the inwardly tapering portion of the sidewall adjacent the closed end and the exterior of said beverage holder, and forming a hole in the sidewall of said container to permit the expulsion of air during insertion of the beverage holder therein and to prevent a vacuum during removal of the beverage holder from said container.

5. The method of claim 1 wherein the opening is formed in the cylindrical element.

6. The method of claim 1 wherein the opening is formed in the base.

7. The method of manufacturing a container insulation apparatus of claim 4 wherein the wrapping comprises wrapping the sheet of foam along a longitudinal edge around the base, thereby forming a relatively large closed end opposite a smaller open end.

8. A method of manufacturing a container insulation apparatus comprising the steps of wrapping a sheet of foam on a cylindrical base to form a closed end insulated container having a sidewall extending upwardly and inwardly from the base between a closed end and a smaller open end of the container, connecting free edges of the sidewall to form a seam, and inserting a cylindrical beverage holder into the insulated container leaving an annular recessed space between the sidewall and the exterior of said beverage holder.

9. The method of claim 8 further comprising forming an opening in a lower portion of the container.

10. A method of manufacturing a container insulation apparatus comprising wrapping a relatively thin, generally cylindrical sheet element around a relatively thick cylindrical base in one end of the element, securing an outer cylindrical surface of the base to a corresponding inner surface of the relatively thin cylindrical element, securing edges of said sheet element to form a longitudinal seam forming a recessed annular space adjacent to the base, coating exposed surfaces of the base and the cylindrical element and forming an opening through the container insulation apparatus in a portion thereof near the base.

11. The method of manufacturing a container insulation apparatus of claim 10 comprising forming the generally cylindrical element by initially forming a generally rectangular, relatively thin blank having an elongated dimension and a shorter transverse dimension and having one elongated edge portion parallel to the elongated dimension and wherein the wrapping of the cylinder element comprises wrapping the rectangular blank around the relatively thick cylindrical base with a longitudinal edge portion of one face of the blank contacting a cylindrical outer wall of the relatively thick cylindrical base and securing relatively short transverse edges of the blank together prior to coating exposed surfaces of the base and cylindrical element.

12. The method of manufacturing a container insulation apparatus of claim 11 further comprising forming the opening through the blank prior to wrapping the blank and forming the blank with a longitudinal dimension approximately twice a transverse dimension of the blank.

13. A method of manufacturing a container insulation apparatus comprising the steps of wrapping a relatively thin sheet of foam on a relatively thick cylindrical base to form a closed end insulated container having a sidewall tapering inwardly from the closed end part way toward an open end, connecting edges of the sidewall to form a seam perpendicular to the cylindrical base, inserting a cylindrical beverage holder into the insulated container leaving an annular space between the inwardly tapering portion of the sidewall adjacent the closed end and the exterior of said beverage holder, and forming a hole in the sidewall of said container to permit the expulsion of air during insertion of the beverage holder therein and to prevent a vacuum during removal of the beverage holder from said container.

14. The method of claim 10 wherein the opening is formed in the cylindrical element.

15. A method of manufacturing a container insulation apparatus comprising the steps of wrapping a relatively thin sheet of foam on a relatively thick cylindrical base to form a closed end insulated container having a sidewall extending upwardly and inwardly from the base between a closed end and a smaller open end of the container, connecting free edges of the sidewall to form a seam, and inserting a cylindrical beverage holder into the insulated container leaving an annular recessed space between the sidewall and the exterior of said beverage holder.

16. The method of claim 15 further comprising forming an opening in a lower portion of the container.

* * * * *